US006072886A

United States Patent [19]

Frasl et al.

[11] Patent Number: 6,072,886

[45] Date of Patent: Jun. 6, 2000

[54] ELECTROACOUSTIC TRANSDUCER COMPRISING SPRING CONTACTS FORMED WITH AT LEAST ONE BEND

[75] Inventors: Ewald Frasl, Biedermannsdorf; Erich Klein, Himberg; Ernst Ruberl, Guntramsdorf, all of Austria

[73] Assignee: U.S. Philips Corporation, New York, N.Y.

[21] Appl. No.: 09/033,200

[22] Filed: Mar. 2, 1998

[30] Foreign Application Priority Data

Feb. 28, 1997 [EP] European Pat. Off. ..... 97890035

[51] Int. Cl.[7] ..... H04R 25/00

[52] U.S. Cl. ..... 381/409; 381/400; 381/410; 381/420

[58] Field of Search ..... 381/400, 401, 381/402, 409, 410, 412, 420, FOR 154, FOR 159, 182, 394

[56] References Cited

U.S. PATENT DOCUMENTS 4,508,941 4/1985 Wiggins ..... 381/412

5,748,760 5/1998 Button ..... 381/400

FOREIGN PATENT DOCUMENTS 2503828 8/1976 Germany ..... H04R 9/00

*Primary Examiner*—Huyen Le

*Attorney, Agent, or Firm*—Edward W. Goodman

[57] ABSTRACT

In an electroacoustic transducer (1) including a substantially hollow cylindrical magnet system (9) which is substantially centro-symmetrical with respect to a transducer axis (2), a diaphragm (17) and a voice coil (16) connected to the diaphragm (17) having two coil leads (20), and two contact terminals which, viewed in the direction of the transducer axis (2), are disposed inside the magnet system (9) and are each connected to one coil lead (20), the contact terminals are spring contacts (21, 22) which are formed with at least one bend and are preferably U-shaped, having two limbs (23, 24) extending transversely to the transducer axis (2) and including a first limb (23), which is mechanically connected to a contact holder (26) of the transducer (21), and a second limb (24) having contact faces (25) which are movable parallel to the transducer axis (2), the contact faces (25) of both spring contacts (21, 22) having different radial distances from the transducer axis (2).

6 Claims, 2 Drawing Sheets

ELECTROACOUSTIC TRANSDUCER COMPRISING SPRING CONTACTS FORMED WITH AT LEAST ONE BEND

BACKGROUND OF THE INVENTION

1. Field of the Invention

The invention relates to an electroacoustic transducer comprising a substantially hollow cylindrical magnet system which is substantially centro-symmetrical with respect to a transducer axis, a diaphragm which is capable of vibrating in the direction of the transducer axis, a voice coil which is connected to the diaphragm, which has been wound from coil wire, and which has two coil leads, and two contact terminals which, viewed in the direction of the transducer axis, are disposed inside the substantially hollow cylindrical magnet system and which are each connected to one coil lead.

2. Description of the Related Art

An electroacoustic transducer of the type defined in the opening paragraph is known from German Patent schrift DE 25 03 828 C3. In this known transducer the two contact terminals are formed by two contact pins which extend through the bottom wall of a pot-shaped supporting element, and which are mechanically fastened to this bottom wall, as a result of which, the contact faces formed by the contact tips of the contact pins are immovable, i.e., stationary. However, an undesirable consequence of this is that when a known transducer is mounted in an electroacoustic device, the two contact pins should enter into operative engagement either with resilient mating contacts or with stationary mating contacts which have been positioned very accurately with respect to the contact tips, in order to assure proper contact between the contact tips of the contact pins and the mating contacts. In the known transducer, the two contact pins have exactly equal radial distances from the transducer axis, as a result of which the known transducer cannot be mounted or built into an electroacoustic device in an arbitrary relative position because the contact pins do not enter into operative engagement with the mating contacts provided in the relevant electroacoustic device in the case of an incorrect relative position; this makes it more expensive to mount the known transducer.

SUMMARY OF THE INVENTION

It is an object of the invention to preclude the above-mentioned problems and to provide an improved transducer of the type defined in the opening paragraph. To achieve this object, according to the invention, an electrodynamic transducer of the type defined in the opening paragraph, is characterized in that the contact terminals are formed by spring contacts formed with at least one bend, these spring contacts having at least two limbs which extend transversely to the transducer axis and each having a first limb mechanically connected to a part of the transducer, and a second limb having contact faces for engagement with mating contacts, the contact faces being movable substantially parallel to the transducer axis, and the contact faces of both spring contacts having different radial distances from the transducer axis. The construction of the contact terminals as spring contacts having at least one bend and having contact faces which are movable substantially parallel to the transducer axis, ensures that contact faces of the spring contacts always engage properly with the mating contacts of an electroacoustic device, while dimensional tolerances can be substantially ignored. It is to be noted that it is particularly advantageous that the spring contacts have at least one bend, and the limbs of the spring contacts extend transversely to the transducer axis, because, in this way, the construction of the spring contacts and, as a consequence, of the entire transducer is also very compact in radial directions. The construction of the spring contacts with at least one bend further has the advantage that it is possible to accommodate both spring contacts almost wholly inside the hollow cylindrical magnet system. Besides, due to the measure that in a transducer in accordance with the invention, both spring contacts have different radial distances from the transducer axis, it is achieved in a simple manner that a transducer in accordance with the invention can be mounted in any desired relative position in an electroacoustic device in which the contacts adapted to mate with the spring contacts are annular and coaxial with the transducer axis, i.e., the transducer need not be brought into a given relative position, which has the advantage that mounting of the transducer in such a device can be as simply as possible.

In a transducer in accordance with the invention, it has proven to be advantageous if the first limbs of the spring contacts formed with at least one bend are mechanically connected to a bottom wall of a substantially pot-shaped contact holder which is mounted in a hollow cylindrical part of the magnet system with its hollow cylindrical circumferential wall. This is advantageous for a simple mounting of the spring contacts in a transducer in accordance with the invention.

In a transducer in accordance with the invention, it has proven to be very advantageous if the two spring contacts formed with at least one bend are disposed, at least for the greater part, inside the substantially hollow cylindrical magnet system, also viewed in a direction transverse to the transducer axis. In this way, the dimension of a transducer in accordance with the invention can also be particularly small in the direction of the transducer axis.

In a transducer as defined in the preceding paragraph, the spring contacts can be situated wholly inside the substantially hollow cylindrical magnet system, viewed in a direction perpendicular to the transducer axis. However, it has proven to be very advantageous if the contact faces of the two spring contacts formed with at least one bend are disposed outside the substantially hollow cylindrical magnet system, viewed in a direction transverse to the transducer axis. This is advantageous for an as simple as possible engagement of the spring contacts with mating contacts of an electroacoustic device when a transducer in accordance with the invention is mounted in such an electroacoustic device.

In all the above-mentioned variants of a transducer in accordance with the invention, the spring contacts can be formed with two bends, i.e., sentially S-shaped. A construction with more bends is also possible. However, it has proven to be very advantageous if the two spring contacts are formed with only one bend and, as a consequence, are substantially U-shaped. This is a satisfactory compromise between a compact construction and a gentle spring characteristic.

All the above-mentioned variants of a transducer in accordance with the invention are characterized in that the value of the outer diameter of the transducer is, at most, 20.0 mm. These transducers consequently have a particularly compact construction.

The above-mentioned as well as further aspects of the invention will become apparent from the embodiment described hereinafter by way of example and will be elucidated by means of this embodiment.

BRIEF DESCRIPTION OF THE DRAWINGS

The invention will now be described in more detail with reference to the drawing, which shows an embodiment to which the invention is not limited, in which.

DESCRIPTION OF THE PREFERRED EMBODIMENTS

Figure 1:
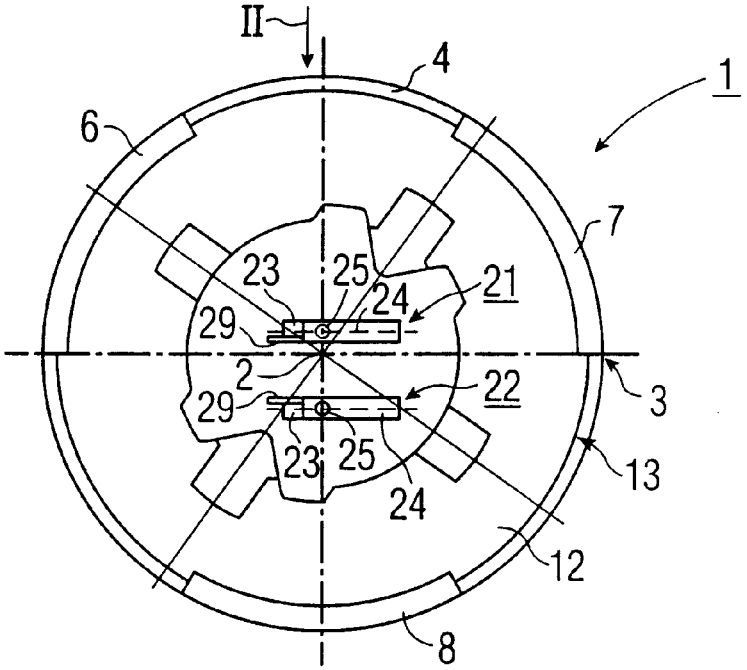
FIG. 1 is an underneath view taken at the arrow I in FIG. 2 and showing an electrodynamic transducer embodying the invention, which comprises two contact terminals formed by two substantially U-shaped spring contacts.
Figure 2:
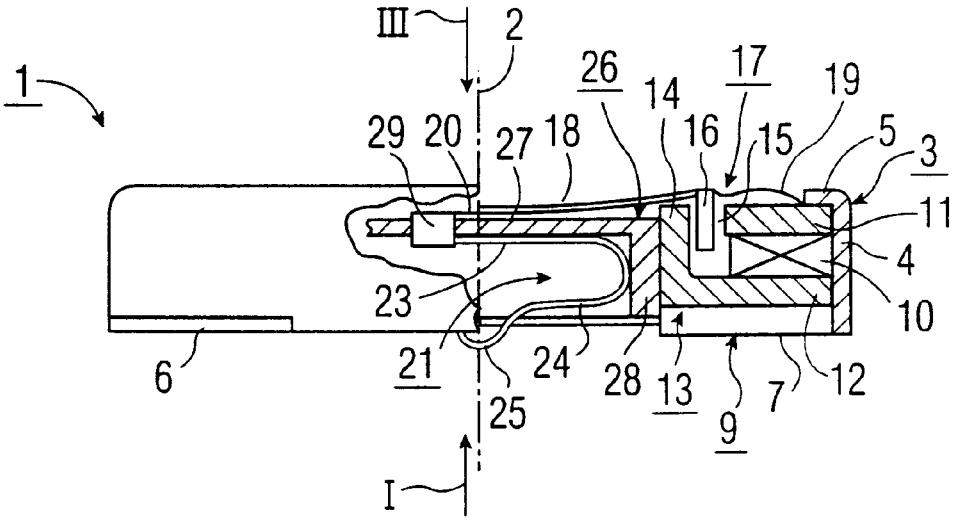
FIG. 2 shows the transducer of FIG. 1 in a side view taken at the arrow II in FIG. 1 and partly in sectional view.
Figure 3:
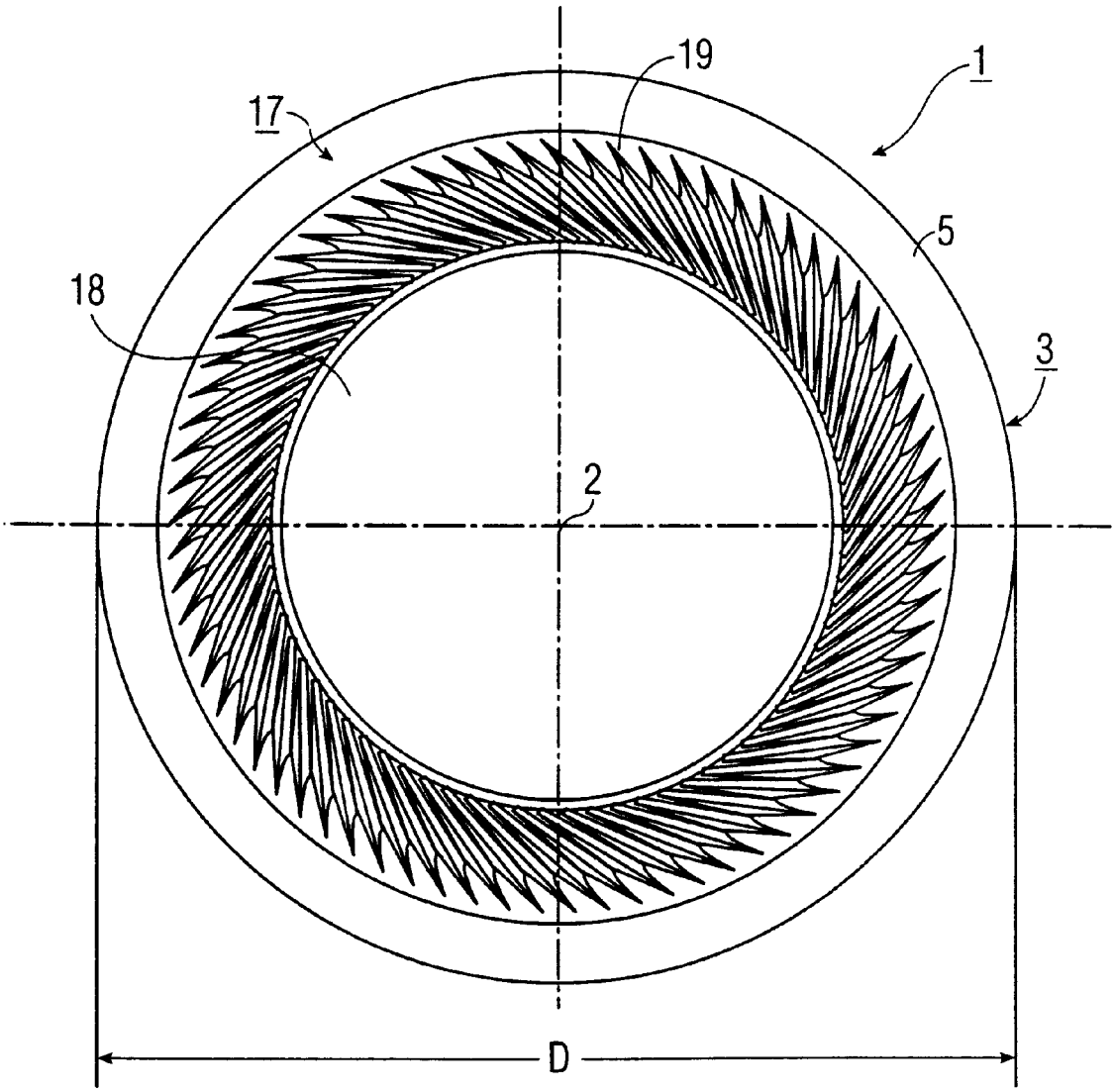
FIG. 3 shows the transducer of FIGS. 1 and 2 in a plan view taken at the arrow III in FIG. 2.

FIGS. 1 to 3 show an electrodynamic transducer 1 having a transducer axis 2. To accommodate and hold the individual parts of the transducer 1, the latter comprises a plastic housing 3. The housing 3 essentially comprises a hollow cylindrical circumferential wall 4, which changes into a narrow annular bounding wall 5 at the top and which has three mounting projections 6, 7 and 8 at the bottom, which are spaced at equal angles from one another. Prior to assembly of the transducer 1, the mounting projections 6, 7 and 8 project from the circumferential wall 4 in axial directions, and after all the parts of the transducer 1 have been mounted in the housing 3, said projections are bent by means of an ultrasonic process.

The transducer 1 comprises a substantially hollow cylindrical magnet system 9, which is substantially centrosymmetrical with respect to the transducer axis 2 and whose construction is apparent from FIG. 2. The magnet system 9 comprises a ring magnet 10, which is adjoined by an annular cover disc 11 at its upper side and by an annular core disc 12 of a yoke 13 at its lower side. The yoke 13 comprises the annular core disc 12 and, in addition, a hollow cylindrical yoke portion 14, whose end which is remote from the core disc 12 extends into the area of the cover disc 11, namely, in such a manner that an annular air gap 15 is formed between the cover disc 11 and the yoke portion 14.

A voice coil 16 wound from coil wire is arranged in the air gap 15 and is shown only diagrammatically in FIG. 2 because such a construction of a coil wound from coil wire is generally known. In known manner the voice coil 16 is secured to a diaphragm 17 by means of an adhesive joint, this diaphragm being able to perform excursions in the direction of the transducer axis 2. The diaphragm 17 comprises a curved central portion 18 and an annular peripheral portion 19 which is connected to the cover disc 11 by an adhesive with its edge zone 8, which lies between the narrow annular bounding wall 5 of the housing 3 and the cover disc 11.

In the transducer 1 shown in FIGS. 1 to 3, the cover disc 11, the ring magnet 10, the core disc 12 of the yoke 13 and the diaphragm 17 all have the same outer diameter, which is adapted accurately to the inner diameter of the circumferential wall 4 of the housing 3 in such a manner that the core disc 12 of the yoke 13, the ring magnet 10 as well as the cover disc 11 and, consequently, also the diaphragm 17 are positioned exactly with respect to the transducer axis 2 by means of the circumferential wall 4 of the housing 3. This also results in an exact positioning of the voice coil 16 in the air gap 15, so that always an unimpeded vibration of the voice coil 16 is guaranteed.

The voice coil 16 made of coil wire has two coil leads 20, of which only one lead 20 is shown in FIG. 2. The transducer 1 further has two contact terminals, which are both shown in FIG. 1, but only one of these contact terminals is visible in FIG. 2. Each of the two contact terminals is electrically connected to a coil lead, preferably by soldering, but clamping is also possible. Viewed in the direction of the transducer axis, the two contact terminals are disposed inside the substantially hollow cylindrical magnet system 9.

As is apparent from FIG. 2, the contact terminals in the transducer shown in FIGS. 1 to 3 are preferably formed by substantially U-shaped spring contacts 21 and 22 having limbs 23 and 24, which extend transversely to the transducer axis 2, of which a first limb 23 is mechanically connected to a part of the transducer 1, and of which a second limb 24 has contact faces 25 for cooperation with mating contacts, the contact faces 25 being movable substantially parallel to the transducer axis 2. The contact faces 25 are each formed by a spring contact portion bent away from the second limb 24. Suitably, the two contact faces 25 of the two spring contacts 21 and 22 are situated at different radial distances from the transducer axis 2, as is clearly shown in FIG. 1.

As stated hereinbefore, the first limb 23 of each of the two spring contacts 21 and 22 is mechanically connected to a part of the transducer 1. This part of the transducer 1 for mounting the two spring contacts 21 and 22 is formed by a substantially pot-shaped contact holder 26. The first limbs 23 of the two U-shaped spring contacts 21 and 22 are mechanically connected to a bottom wall 27 of the pot-shaped contact holder 26. By means of its hollow cylindrical circumferential wall 28, the pot-shaped contact holder 26 is mounted in the hollow cylindrical yoke portion 14 of the yoke 13 of the magnet system 9.

At the location of its free end, the first limb 23 of each of the two U-shaped spring contacts 21 and 22 has a terminal lug 29, which is inclined relative to said limb and which extends through the bottom wall 27 of the pot-shaped contact holder 26 and is connected to a respective coil lead 20. In this way, the two terminal lugs 29 provide an electrical connection between, on the one hand, the coil leads 20 and, consequently, the voice coil 26 and, on the other hand, the two U-shaped spring contact 21 and 22.

As also stated hereinbefore, the U-shaped spring contacts 21 and 22 are situated inside the substantially hollow cylindrical magnet system 9, viewed in the direction of the transducer axis 2. As is apparent from FIG. 2, the two U-shaped spring contacts 21 and 22 of the transducer 1 as shown in FIGS. 1 to 3 are disposed, at least for the greater part, inside the substantially hollow cylindrical magnet system 9, also viewed in a direction transverse to the transducer axis 2. Viewed in a direction transverse to the transducer axis 2, only the contact faces 25 of the two U-shaped spring contacts 21 and 22 are situated outside the substantially hollow cylindrical magnet system 9.

As regards the electrodynamic transducer 1 of FIGS. 1 to 3, it is to be noted that this transducer 1 is shown to an enlarged scale, i.e., approximately five times full scale. At full scale of the transducer 1, of the outer diameter D of the transducer 1 indicated in FIG. 3 has a nominal value of 13.2 mm. The transducer 1 is, therefore, particularly compact and is, therefore, very suitable for use in telecommunication devices, such as, portable telephones and the like.

In the transducer 1 as shown in FIGS. 1 to 3, a proper contact engagement with mating contacts of an electroacoustic device, such as, a portable telephone or the like, is always guaranteed due to the construction of the contact terminals as U-shaped spring contacts 21 and 22, having contact faces 25 movable substantially parallel to the transducer axis 2. As a result of the U-shaped construction of the spring contacts 21 and 22, since the two limbs 23 and 24 extend adjacent one another in the direction of the transducer axis 2, the spring contacts 21 and 22, and, consequently, the entire transducer 1, are very compact in radial directions. The U-shaped construction of the two spring contacts 21 and 22 further has the advantage that both spring contacts are accommodated substantially wholly inside the magnet system 9 of the transducer 1. Since the two spring contacts 21 and 22 have different radial distances from the transducer axis 2, it is further achieved, in a simple manner, that the transducer 1 can be mounted in an electroacoustic device in an arbitrary relative position if this device comprises a circular and an annular contact, which are both coaxial with the transducer axis 2, or two annular mating contacts, which are coaxial with the transducer axis 2, for cooperation with the spring contacts 21 and 22.

The invention is not limited to the embodiment described above by way of example. In the embodiment described above, the first limb 23 of the two U-shaped spring contacts 21 and 22 is fully straight, i.e., rectilinear. However, if desired, this first limb can also be bent if this is required in view of the available space or for reasons of design. In the embodiment described above, the outer second limb 24 covers the inner first limb 23 of each of the two U-shaped spring contacts 21 and 22 for the greater part, viewed in the direction of the transducer axis 2, since the two limbs 23 and 24 of each spring contact 21 or 22 extend parallel to one another. However, it is possible to arrange the outer limb 24 in an inclined position with respect to the inner limb 23. It is also possible to use S-shaped spring contacts instead of U-shaped spring contacts.

What is claimed is:

1. An electroacoustic transducer comprising:

a substantially hollow cylindrical magnet system substantially centro-symmetrical with respect to a transducer axis;

a diaphragm capable of vibrating in a direction of the transducer axis;

a voice coil connected to the diaphragm, said voice coil having been wound from coil wire and having two coil leads; and two contact terminals disposed, when viewed in the direction of the transducer axis, inside the substantially hollow cylindrical magnet system, said contact terminals being connected, respectively, to said coil leads, characterized in that the contact terminals are formed by spring contacts formed with at least one bend, said spring contacts having at least two limbs extending transversely to the transducer axis, and each having a first limb mechanically connected to a part of the transducer, and a second limb having contact faces for engagement with mating contacts, said contact faces being movable substantially parallel to the transducer axis, and the contact faces of both spring contacts having different radial distances from the transducer axis.

2. A transducer as claimed in claim 1, characterized in that the first limbs of the spring contacts formed with at least one bend are mechanically connected to a bottom wall of a substantially pot-shaped contact holder having a hollow cylindrical circumferential wall by which the substantially pot-shaped contact holder is mounted in a hollow cylindrical part of the magnet system.

3. A transducer as claimed in claim 1, characterized in that the two spring contacts formed with at least one bend are disposed, at least for the greater part, inside the substantially hollow cylindrical magnet system, viewed in a direction transverse to the transducer axis.

4. A transducer as claimed in claim 3, characterized in that the contact faces of the two spring contacts formed with at least one bend are disposed outside the substantially hollow cylindrical magnet system, viewed in a direction transverse to the transducer axis.

5. A transducer as claimed in claim 1, characterized in that the two spring contacts are formed with only one bend and are substantially U-shaped.

6. A transducer as claimed in claim 1, characterized in that the outer diameter of the transducer is, at most, 20.0 mm.

* * * * *